US010408590B1

(12) United States Patent
Campagnuolo et al.

(10) Patent No.: US 10,408,590 B1
(45) Date of Patent: Sep. 10, 2019

(54) FLASH OUTPUT FOR PROJECTILE TRAINING

(71) Applicant: U.S. Government as Represented by the Secretary of the Army, Picatinny Arsenal, Dover, NJ (US)

(72) Inventors: Carl J. Campagnuolo, Sarasota, FL (US); William J. Andrews, Tampa, FL (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/169,192

(22) Filed: Oct. 24, 2018

(51) Int. Cl.

| | |
|---|---|
| ***F42B 12/40*** | (2006.01) |
| ***F42B 8/12*** | (2006.01) |
| ***F42B 12/48*** | (2006.01) |
| ***F42B 12/44*** | (2006.01) |

(52) U.S. Cl.
CPC ..... *F42B 12/40* (2013.01); *F42B 8/12* (2013.01); *F42B 12/44* (2013.01); *F42B 12/48* (2013.01)

(58) Field of Classification Search
CPC .. F42B 8/12; F42B 12/40; F42B 12/42; F42B 12/365; F42B 12/48
See application file for complete search history.

(56) References Cited

U.S. PATENT DOCUMENTS

| | | | | | |
|---|---|---|---|---|---|
| 3,374,741 | A * | 3/1968 | Bass | F42B 12/38 | 102/513 |
| 3,467,012 | A * | 9/1969 | Lapof | F42B 12/50 | 102/364 |
| 3,645,208 | A * | 2/1972 | Weinssen | F42B 8/02 | 102/513 |
| 3,649,020 | A * | 3/1972 | Hall | F42B 6/10 | 102/513 |
| 3,830,671 | A * | 8/1974 | McArdle | C06B 33/02 | 102/335 |
| 4,096,804 | A * | 6/1978 | Bilsbury | F42B 12/44 | 102/364 |
| 4,488,490 | A * | 12/1984 | Betts | F42C 1/10 | 102/204 |
| 5,035,183 | A * | 7/1991 | Luxton | F42B 8/16 | 102/447 |
| 5,341,745 | A * | 8/1994 | Strandli | F42B 12/44 | 102/364 |

(Continued)

FOREIGN PATENT DOCUMENTS

| | | | | |
|---|---|---|---|---|
| DE | 1056006 B | * | 4/1959 | F42B 12/48 |
| FR | 1082452 A | * | 12/1954 | F42B 12/12 |

(Continued)

*Primary Examiner* — Joshua T Semick
(74) *Attorney, Agent, or Firm* — Michael C. Sachs

(57) ABSTRACT

In an ammunition training round having a crushable nose section, a flash system which makes an impact more visible to the user in the air or on land when the round hits a ground target. In place of a fuze ignition, the flash system utilizes incendiary energetic pellets comprising ignition pellets which burst in flames when impacted. The round may also have a nose area with a lower portion plastic plug and an upper portion fuze ogive containing the ignition pellets so that when the round impacts the ground at an angle, the upper portion of the nose area snaps off and exposes its ignition pellets to ignite from the impact.

5 Claims, 5 Drawing Sheets

(56) References Cited

U.S. PATENT DOCUMENTS

| | | | | |
|---|---|---|---|---|
| 6,722,283 | B1 * | 4/2004 | Dindl | F42B 5/145 102/370 |
| 8,402,896 | B1 * | 3/2013 | Hollerman | F42B 12/40 102/458 |
| 8,607,708 | B1 * | 12/2013 | McClenahan | F42B 12/40 102/491 |
| 9,702,678 | B1 * | 7/2017 | Moretti | F42B 12/44 |
| 9,778,004 | B2 * | 10/2017 | Rumfitt | F42B 12/64 |
| 2005/0034627 | A1 * | 2/2005 | Manole | F42B 12/382 102/513 |
| 2010/0282117 | A1 * | 11/2010 | Cranor | F42B 12/40 102/513 |

FOREIGN PATENT DOCUMENTS

| | | | | | |
|---|---|---|---|---|---|
| GB | 191329979 | A | * | 9/1914 | F42B 12/40 |
| GB | 191329991 | A | * | 9/1914 | F42B 12/40 |
| GB | 191403069 | A | * | 11/1914 | F42B 12/40 |
| GB | 191402724 | A | * | 1/1915 | F42B 12/40 |
| GB | 191415036 | A | * | 6/1915 | F42B 12/40 |

* cited by examiner

FLASH OUTPUT FOR PROJECTILE TRAINING

U.S. GOVERNMENT INTEREST

The inventions described herein may be made, used, or licensed by or for the U.S. Government for U.S. Government purposes.

BACKGROUND OF INVENTION

In training hitherto conducted by the military with specific training ammunition, impact at a target such as a ground target would then be noticed through discharge of flash charges ignited by fuze circuitry. It is necessary that target impact be registered, visible from the air as well as at the ground level. Some projectiles such as the 105 mm training round PGU 43/B for the AC 130 aircraft contain a point detonating fuze, which at impact causes two flash charges to ignite by means of a booster in the fuze. The flash charges contain an explosive that breaks the projectile, making the flashes visible from the aircraft at the impact area. The existing systems are expensive and lack interchange ability between different round types and between different caliber sizes. Therefore any improvement in these areas would benefit with these unfulfilled needs.

BRIEF SUMMARY OF INVENTION

This invention provides an ammunition training round having a flash system which makes an impact more visible to the user in the air or on land when the round hits a ground target. In place of a fuze ignition, the flash system utilizes incendiary energetic pellets comprising ignition pellets which burst in flames when the tip of the round is crushed upon impact. In another version for larger caliber training rounds there is provided a flash system where the round nose area has a lower portion plastic plug and an upper portion fuze ogive containing ignition pellets such that when the round impacts ground at an angle, the upper portion of the nose area snaps off and exposes its ignition pellets to ignite from such impact.

OBJECTS OF THE INVENTION

Accordingly, it is an object of the present invention to provide an ammunition training round having a flash system which makes an impact more visible to the user in the air or on land when the round hits a ground target.

Another object of the present invention is to provide an ammunition training round having a breakable nose section, and having a flash system which makes an impact more visible to the user in the air or on land when the round hits a ground target to expose incendiary pellets which thereby ignite.

It is a further object of the present invention to provide an ammunition training round having a flash system which makes an impact more visible to the user in the air or on land when the round hits a ground target where, in place of a fuze ignition, the flash system utilizes incendiary energetic pellets comprising ignition pellets which flash when the tip of the round is crushed upon impact.

It is yet another object of the present invention to provide a flash system for a large caliber ammunition training round where the round has a nose area with a lower portion plastic plug and an upper portion fuze ogive containing ignition pellets so that when the round impacts ground at an angle, the upper portion of the nose area snaps off and exposes its ignition pellets to ignite from such impact.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
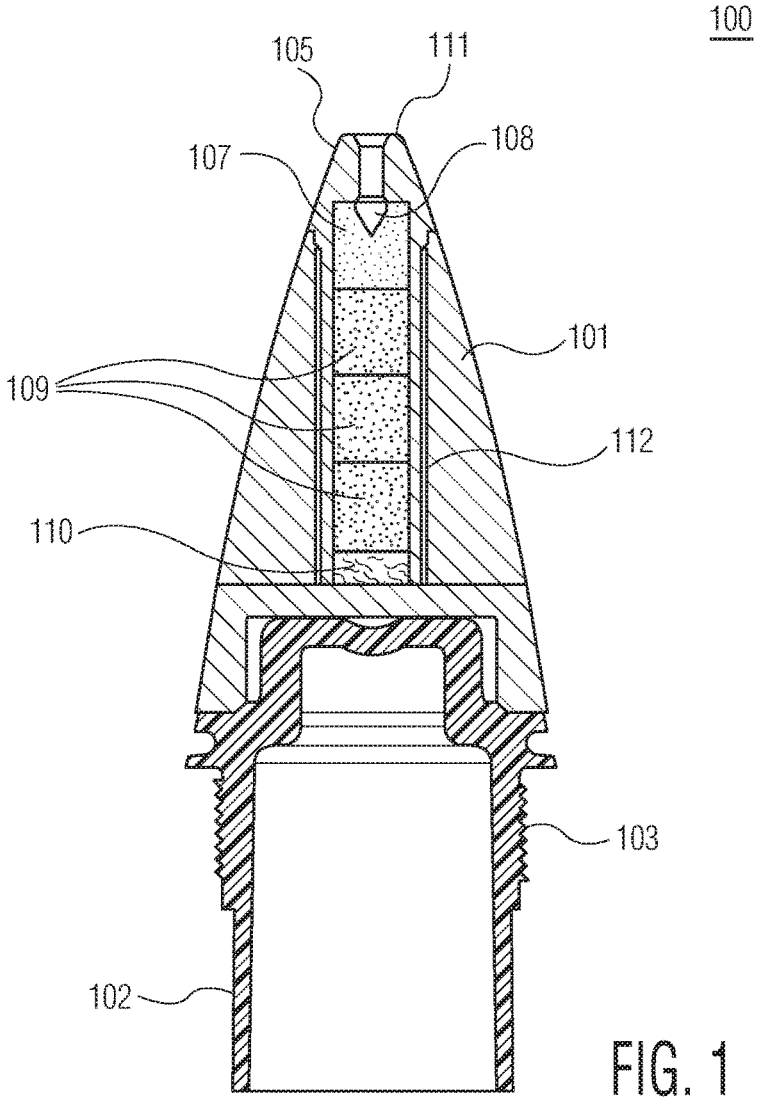
FIG. 1 is a cross sectional view of a modified PGU 43/B, 105 mm training round, according to this invention.
Figure 2:
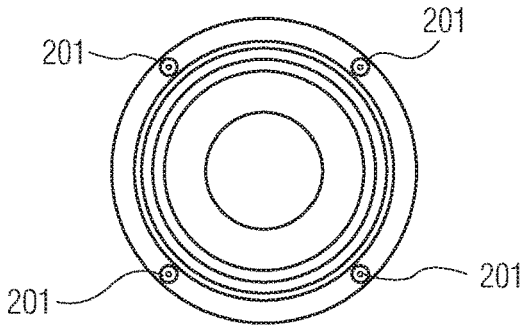
FIG. 2 is a bottom view of the modified PGU 43/B round of FIG. 1, according to this invention.
Figure 3A:
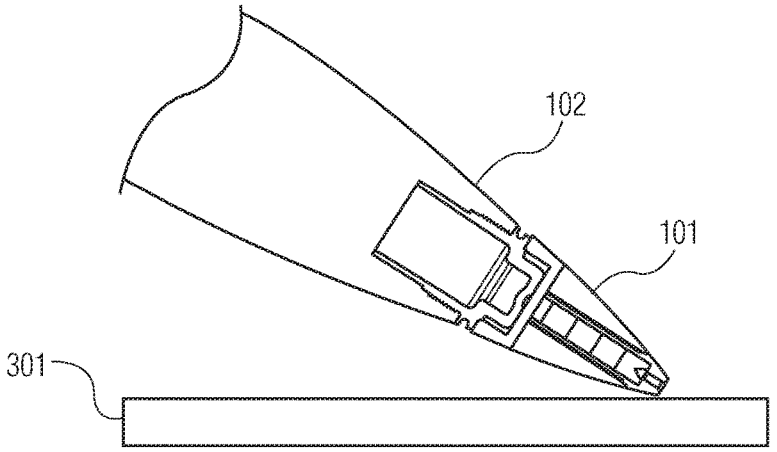
FIGS. 3A, 3B and 3C illustrate how the modified PGU 43/B round impacts ground at a possible 60-70° angle and the front area snaps apart according to this invention.
Figure 3B:
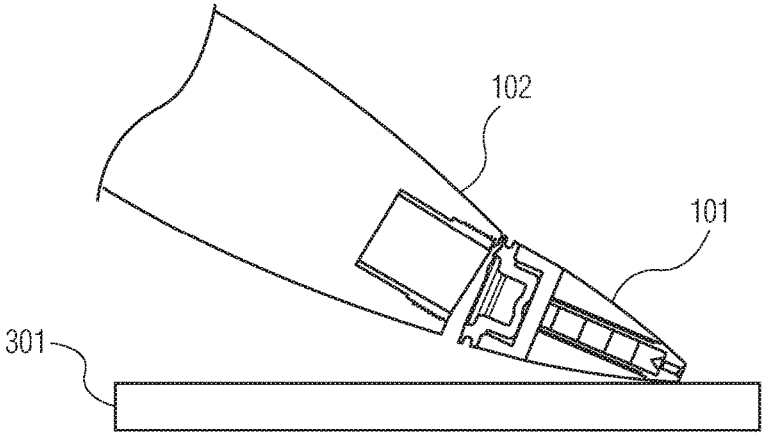
Figure 3C:
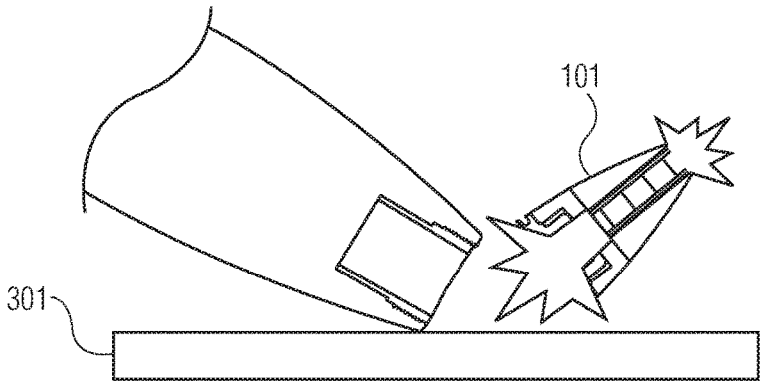
Figure 4:
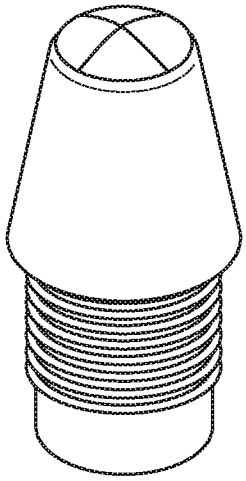
FIG. 4 illustrates how a conventional training round might have its front tip area scored into an 'X' shape according to this invention.
Figure 5:
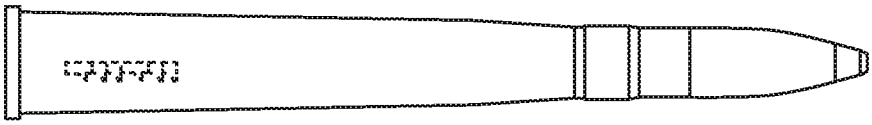
FIG. 5 illustrates a conventional medium caliber 40 mm training round to which a flash system according to this invention may be applied.
Figure 6A:
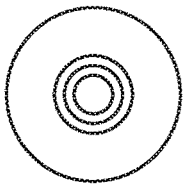
FIG. 6A illustrates a cross sectional view and FIG. 6B illustrates the frontal view of the tip region of a medium caliber training round implementing a flash output system according to this invention.
Figure 6B:
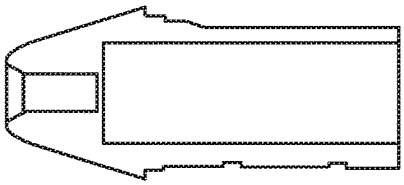
Figure 7:
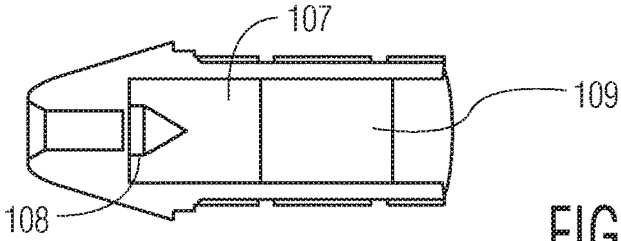
FIG. 7 illustrates a cross sectional view of another medium caliber training round implementing a flash output system according to this invention.
Figure 8:
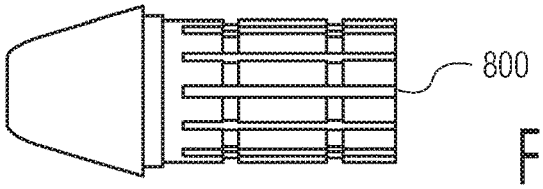
FIG. 8 shows an outside view of the tip region of another medium caliber training round implementing a flash output system, this having an outer pattern of ridges 800 to secure the tip within the ogive, according to this invention.
Figure 9:
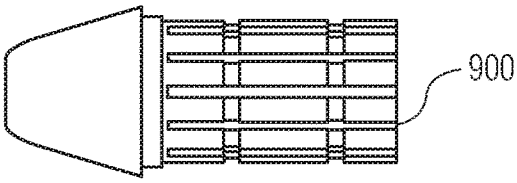
FIG. 9 shows an outside view of the tip region of yet another medium caliber training round implementing a flash output system, this having a different outer pattern of ridges 900 to secure the tip within the ogive, according to this invention.
Figure 11:
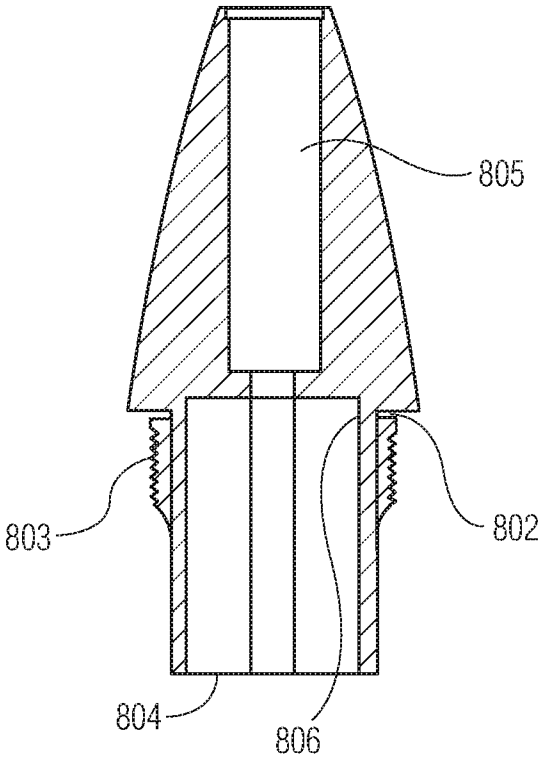
FIG. 11 illustrates a cross sectional view of the flash system of FIG. 10 and showing the undercut feature.
Figure 10:
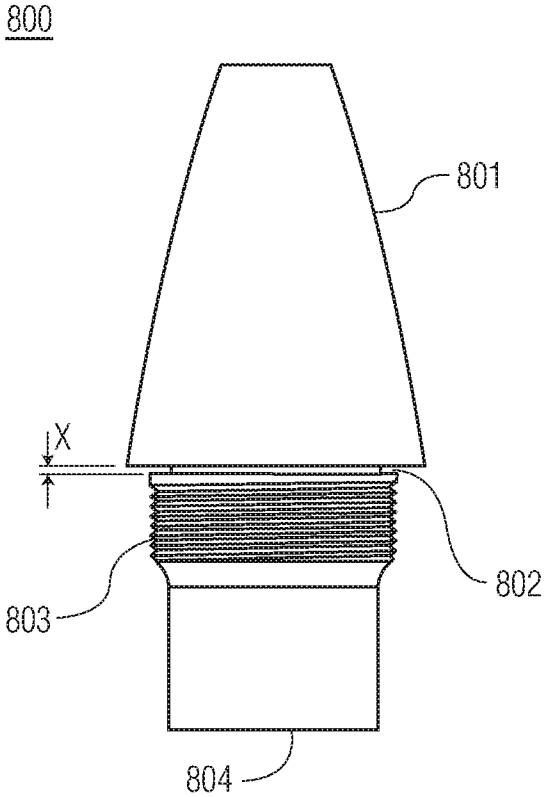
FIG. 10 illustrates a frontal view of a 105 MM training round, with a configuration having an undercut area below the warhead cone, implementing yet another flash output system according to this invention.

Several projectiles are shown which will emit a flash to designate an impact position (of a target). Some projectiles such as the 105 mm training round PGU 43/B for the AC 130 aircraft contain a point detonating fuze, which at impact causes two flash charges to ignite by means of a booster in the fuze. The flash charges contain an explosive that breaks the projectile, making the flashes visible from the aircraft at the impact area. A new system is shown for small caliber munitions, e.g., 40 mm medium caliber projectiles to also designate an impact position making it visible from the aircraft above. The system comprises a cylindrical device containing two incendiary pellets placed in the nose of the projectile in lieu of a fuze (FIG. 7, e.g.). The device comprises a conical shape cylinder (known as the tip), which when fired from the aircraft collapses at ground impact and jams into the front of the first incendiary pellet 107. The first pellet causes second pellet(s) 109 to ignite and the resulting flash becomes visible from the aircraft above, as a spotting charge. The tip (FIG. 7, e.g.) shows square blocks that house the pellets. The front most pellet 107 has a triangular cut out 108 for it to accept compressed metal of the compacted tip, which causes the front most pellet to ignite which further causes the after positioned pellets 109 to ignite in tandem. The tip shown is coated with an adhesive prior to being pressed into an ogive. More detailed drawings of a tip are shown in FIGS. 5, 6A and 6B-9. The pellets are held within the tip with an epoxy adhesive (stycast 1090SI and a catalyst 23LV). The pellets are manufactured from an incendiary mix so that they ignite at impact with the ground. The tip will contract and exerts a pressure force on the pellets causing them to ignite. There is a felt pad 110 at the end of the incendiary pellets 109 for spacing purposes. This system has been applied to the 40 mm M81A1 and was tested on the ground and from an aircraft with positive results. This invention also applies these concept to other projectiles that are heavier than a 40 mm round, for example the M1 larger caliber projectile fired from a M105 gun, mid caliber round is heavier than the 40 mm round. This concept is applicable to an M1 training round known as a PGU-43 (projectile gun unit 43). The standard round contains a point detonating fuze (PD) that when armed, at impact a stab detonator will ignite a booster, which in turn ignites two flash charges. The explosive contained in the flash charge breaks open the M1 projectile and the flashes from the explosive charges are visible at the aircraft above. The replacement of this system by this invention (with one embodiment captioned as 100 in FIG. 1, e.g.) will provide a simpler device, not containing an HE explosive, and which is also safer and meets insensitive munition (IM) requirements. A system according to the invention to use with the mid caliber PGU-43/B round is seen in FIGS. 1 and 2. The system comprises two segments, a fuze ogive (upper portion) 101 and a plastic plug (lower portion) 102. The plastic plug is attached to the upper portion by means of four (4) screws 201 (FIG. 2, e.g.), positioned 90° apart. The plastic part is attached to an M1 inert projectile by a standard fuze thread 103. A larger caliber projectile (the PGU 43) will weigh approximately 25 pounds and exits from the gun barrel at a velocity of about 1500 ft./sec and impacts the ground at a velocity of approximately 1000 ft./sec at a 60-70° angle (FIGS. 3A, 3B and 3C, e.g.). The force at impact causes ignition pellets in the ogive to ignite and the impact angle will snap the upper portion of the ogive from the lower plastic portion. This dual action makes the flash from the pellets visible from either the ground or from an aircraft in the vicinity. The embodiment shown in FIGS. 1, 2 and 3A-3B can be made in several variations. The number and size of pellets 107, 109, can vary depending on the required flash intensity or to give off white light or infrared (IR) light, e.g., as may be desired. The pellets are held in place partly by felt piece 110. The configuration of the tip 105 can be made solid with threads that screw into the ogive 101. This approach is preferable so that the pellets can be held in place tightly with no chance of motion during round acceleration from the gun launch. The plastic plug 102 can be filled with a simulant to emulate the weight of the fuze (approximately 1.8 lbs.). In a previous operation of the tip, ram air was ingested prior to impact, passed through a venturi tube to increase velocity, arriving at a thin membrane which breaks to activate the incendiary pellets. This can be changed to have the nose 111 of the ogive scored with an 'X' type shape (see FIG. 4, e.g.) so that on impact with the ground each of the four sections of the 'X' opens up forming four sharply pointed segments which in turn impact the incendiary pellets causing them to ignite. Or, a screw may be placed through the front of the ogive cone with head in the forward direction; at impact the cone crushes and forces the screw into the pellets causing them to ignite. Other variations, in terms of usage, number of pellets, size, etc., are all within the scope of this invention. FIGS. 10-11 show yet another variation of a flash system according to this invention. The example would be in a 105 MM training round. Pellets are present within the nose ogive area, loaded in a concentric through channel 805 which is analogous to 112 of FIG. 1, and in which are loaded ignition pellets such as 107 and 109 and padding 110 similar to those in FIG. 1. Here in FIG. 11, the ogive area is made entirely of aluminum. Also here, an undercut symmetrical groove area 802 is cut below ogive 801, yet immediately at the top of the threaded area 803. The groove in one example has a depth of 0.485 inches and a thickness of 'X'. In one example, 'X' is equal to 0.062 inches. In that example, there is a wall thickness of only 0.125 inches which remains (see points 806, which wall thickness would have to be broken, so that the ogive with its pellets might snap off from the body 804 of the training round, to flash the pellets. Through channel 805 (though not completely shown) opens through to the bottom of the ogive which additionally could allow the pellets to fall through and out. If not already ignited by the impact, this feature would further aid in helping the pellets to ignite.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A flash system for a 105 mm PGU-43/B ammunition round which includes an M1 inert projectile, the flash system configured to make an impact more visible to the user in the air or on land when the round hits a ground target, the flash system comprising:

incendiary ignition pellets (107, 109) which flash when impacted, an upper portion fuze ogive (101) which contains said ignition pellets, said upper portion fuze ogive comprising a nose (111), a lower portion plastic plug (102) comprising a standard fuze thread (103) configured to attach to said M1 inert projectile, wherein said lower portion plastic plug (102) is attached to the upper portion fuze ogive (101) by means of four screws (201) positioned 90 degrees apart, and wherein said ignition pellets ignite when the round impacts the ground (301) at an angle and the upper portion fuze ogive (101) snaps off from the lower portion plastic plug (102) to expose the ignition pellets, which in turn facilitates ignition of the ignition pellets from the impact.

2. The flash system as in claim 1 wherein the ignition pellets are epoxy glued in place and comprise a forward pellet (107) followed by several aft pellets (109) and a felt spacer (110) wherein the forward pellet ignites first and then initiates an energetic train for the aft pellets.

3. The flash system as in claim 2 wherein the number of aft pellets is at least three and where the number and size of pellets may be varied in relation to the flash intensity desired.

4. The flash system as in claim 3 wherein the chemical composition of the ignition pellets is designed so the pellets will produce white light or infrared (IR) light.

5. The flash system as in claim 2 wherein the forward pellet (107) provides a triangular cut space (108) for the nose (111) to collapse into to ignite the forward pellet (107).

* * * * *